US010568450B2

(12) United States Patent
James et al.

(10) Patent No.: US 10,568,450 B2
(45) Date of Patent: Feb. 25, 2020

(54) ARRANGEMENT IN CONNECTION WITH A CURTAIN ROD

(71) Applicant: Healsafe Interiör AB, Göteborg (SE)

(72) Inventors: Franz James, Göteborg (SE); Joakim Thedin, Göteborg (SE)

(73) Assignee: HEALSAFE INTERIÖR AB, Gothenburg (SE)

( * ) Notice: Subject to any disclaimer, the term of this patent is extended or adjusted under 35 U.S.C. 154(b) by 0 days.

(21) Appl. No.: 16/097,249

(22) PCT Filed: Apr. 24, 2017

(86) PCT No.: PCT/SE2017/050397
§ 371 (c)(1),
(2) Date: Oct. 27, 2018

(87) PCT Pub. No.: WO2017/188880
PCT Pub. Date: Nov. 2, 2017

(65) Prior Publication Data

US 2019/0110626 A1 Apr. 18, 2019

(30) Foreign Application Priority Data

Apr. 28, 2016 (SE) ..... 1650570

(51) Int. Cl.
*A47H 1/04* (2006.01)
*A47H 13/04* (2006.01)
(Continued)

(52) U.S. Cl.
CPC ..... *A47H 1/04* (2013.01); *A47H 1/142* (2013.01); *A47H 13/04* (2013.01); *A47H 15/04* (2013.01); *A47H 2001/042* (2013.01)

(58) Field of Classification Search
CPC .... A47H 2001/042; A47H 1/04; A47H 15/04; A47H 1/14; A47H 1/142; A47H 1/144
(Continued)

(56) References Cited

U.S. PATENT DOCUMENTS 1,074,825 A * 10/1913 Walsh ..... A47H 1/122 248/265
3,987,515 A * 10/1976 Suvitie ..... A47H 1/04 16/94 D
(Continued)

FOREIGN PATENT DOCUMENTS

DE 1911449 A1 11/1969
DE 3707133 A1 9/1988
(Continued)

OTHER PUBLICATIONS

Sweden Patent and Registration Office, Int'l Search Report in PCT/SE2017/050397, dated May 31, 2017.
(Continued)

*Primary Examiner* — Jeffrey O'Brien
(74) *Attorney, Agent, or Firm* — Cantor Colburn LLP

(57) ABSTRACT

An apparatus for a curtain rod that is attachable to a ceiling or to a wall and that possesses graspable holders slidable along a sliding rod of the curtain rod and supportable by the same, which graspable holders have devices for holding a curtain. The curtain rod has a ledge-shaped holder base extending along the length of the curtain rod, through which screws are received for fastening the holder base against the ceiling or wall. From the holder base, a ledge-shaped neck extends that supports the sliding rod. An obtuse angle is formed between the holder base and neck, in the space formed between the wall or ceiling where the curtain rod is fastened. At the top, the holders have flanges, at least one flange of which is shape-adapted to the cross-sectional shape
(Continued)

Figure 1:
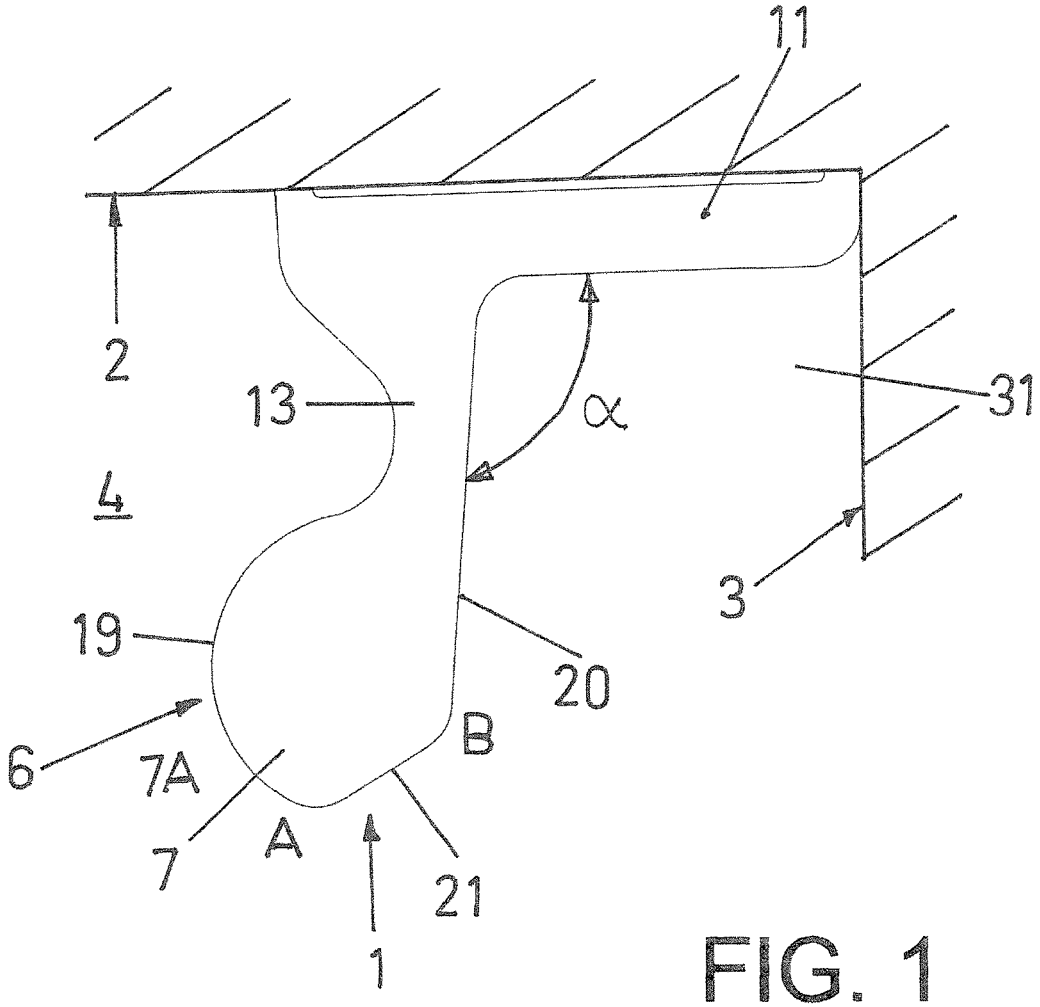

of the sliding rod and possibly to spring apart from the other flange.

17 Claims, 6 Drawing Sheets

(51) Int. Cl.
*A47H 1/142* (2006.01)
*A47H 15/04* (2006.01)

(58) Field of Classification Search
USPC ..... 16/93 D, 95 D, 96 D
See application file for complete search history.

(56) References Cited

U.S. PATENT DOCUMENTS 4,124,918 A * 11/1978 Cummings ..... A47H 15/04 16/93 D
4,134,176 A * 1/1979 Janson ..... A47H 1/04 16/94 D
5,050,750 A * 9/1991 Mason ..... A47B 96/02 211/105.1
5,950,255 A 9/1999 Thompson
6,098,246 A 8/2000 Moir
8,533,910 B2 9/2013 Bennett et al.
2004/0126181 A1 7/2004 Ter Braak
2007/0277944 A1* 12/2007 Wu ..... A47H 1/06 160/330
2009/0114351 A1* 5/2009 Shilts ..... A47H 1/06 160/237
2011/0061819 A1 3/2011 Elinson
2015/0074961 A1* 3/2015 Glaze ..... A47H 15/04 24/716

FOREIGN PATENT DOCUMENTS

DE 3933907 A1 4/1991
EP 0235054 A1 9/1987
GB 715150 A 9/1954
GB 2385511 A 8/2003

OTHER PUBLICATIONS

European Search Report for Serial No. 17790013.1; dated Nov. 7, 2019; pgs.

* cited by examiner

FIG. 5
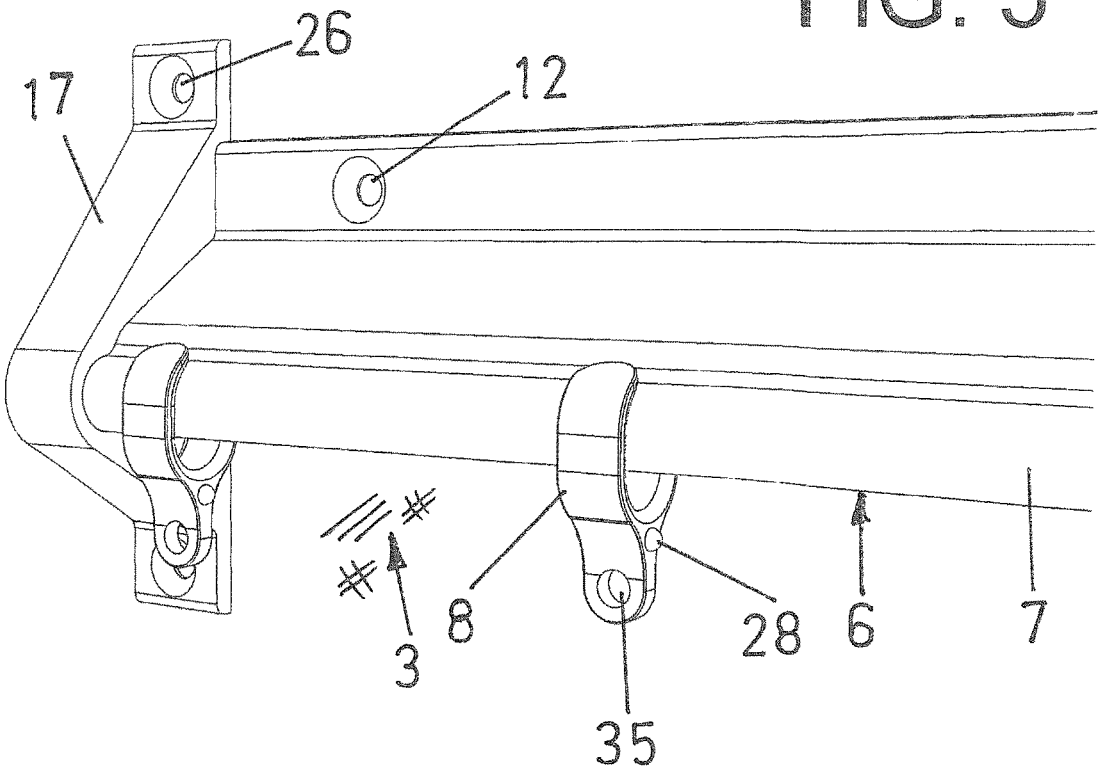
FIG. 6
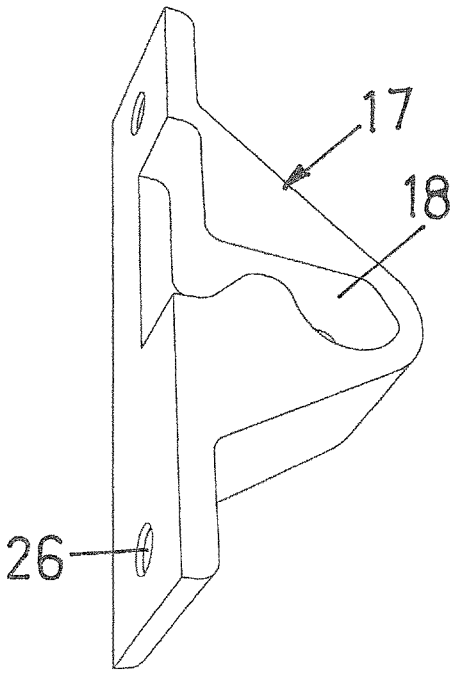
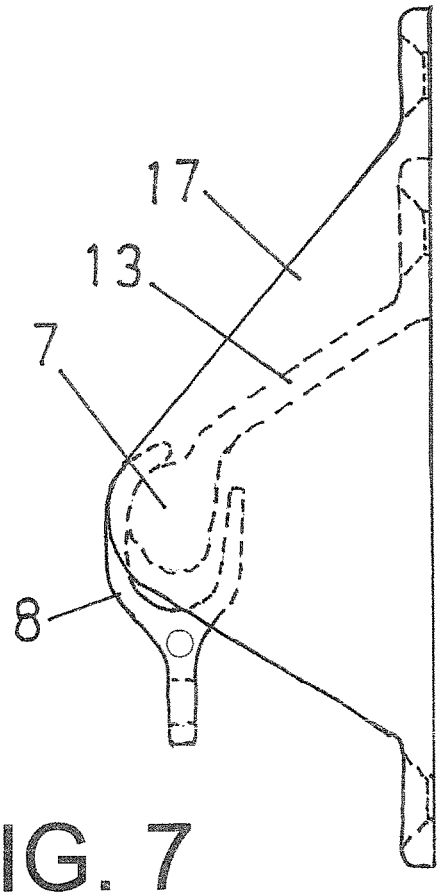
FIG. 7

FIG. 12
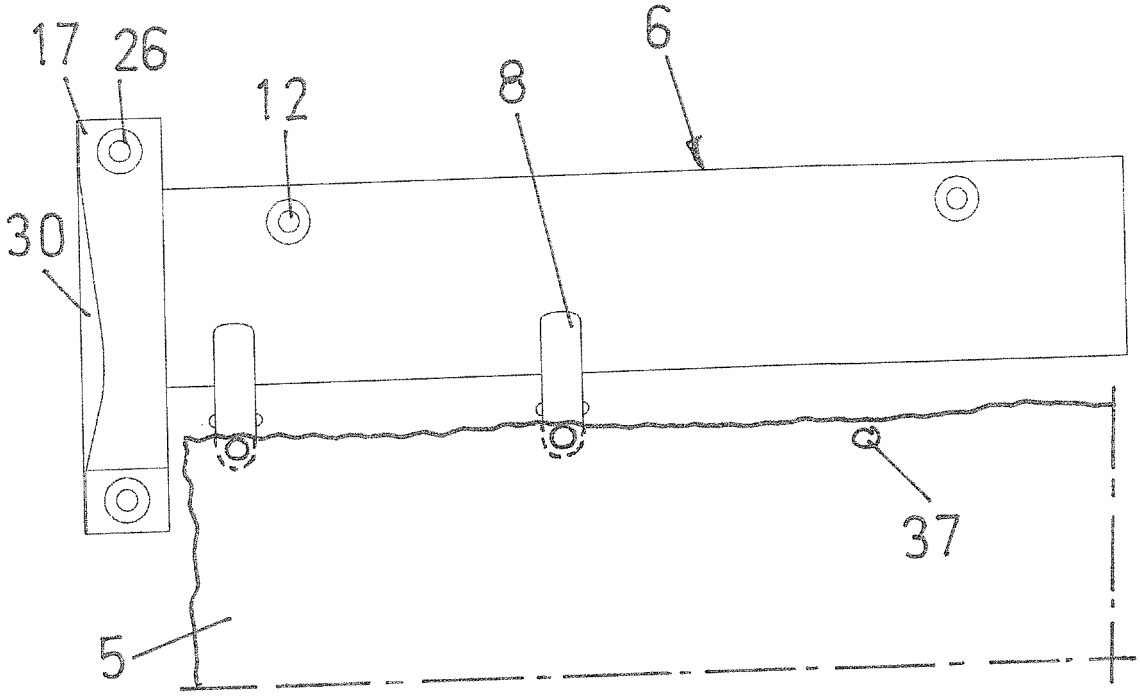
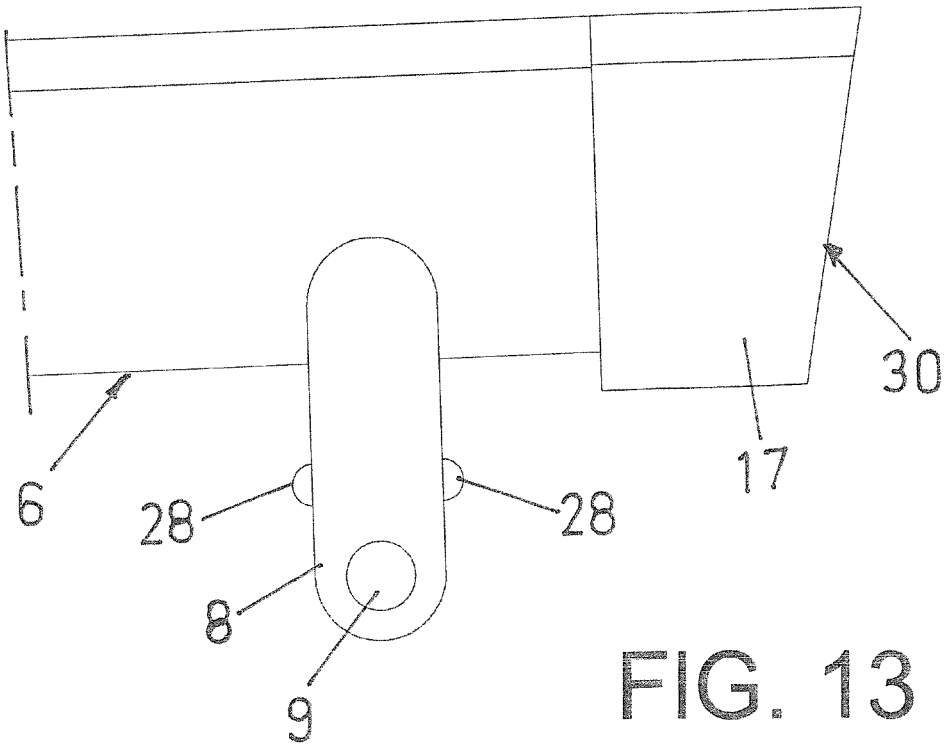
FIG. 13

ARRANGEMENT IN CONNECTION WITH A CURTAIN ROD

The present invention concerns an arrangement in connection with a curtain rod which is attachable to a ceiling or to a wall and which possesses graspable holders slidable along the sliding rod of a curtain rod and supportable by the same, which holders have means for curtain holding.

Curtains give, as is known, a nice and cosy impression of premises. However, there are risks when such are to be suspended on premises where people reside who then risks hurting themselves and other by the use of existing curtain rods and the like.

There are solutions to this problem.

By U.S. Pat. No. 8,533,910 B2, a curtain rod having curtain hooks is known which come loose upon the load of a certain maximum weight, about 23 kg. However, a separate fastener or clip (400, 500) is arranged to carry the curtain rod or track (300) which is bendable. In that connection, said fastener could work as holder for a snare or something else that the person in question could try to hurt himself with. Then it is not enough that the proper holders (100) for curtain hooks (200) and the curtain yields at a certain load of the holders (100).

GB 2385511 A comprises a hollow (3) curtain rod (1) having a holder (2) the flanges (12, 6) of which yield at too high a load. However, there is a risk that the person in question can insert a pen or another elongate object in the hollow (3) of the curtain rod to form a fastener for, e.g., a snare. Particularly if several holders are packed together to form a common fastener.

Problems similar to the above are present in further curtain rods known by GB 715150 A, U.S. Pat. No. 6,098,246 A, DE 3915461 A1, DE 3933907 A1, and DE 3707133 A1.

Thus, the main object of the present invention is to solve, among others, the problems mentioned above in connection with a curtain rod which comprises holders for a curtain so that a suicide-resistant, i.e., anti-ligature curtain suspension is obtained but which consists of simple parts both to manufacture and to use.

Said object is achieved by means of an arrangement according to the present invention, which essentially is characterized in that the curtain rod has a ledge-shaped holder base extending along the length extension of the curtain rod, through which holder base fixing screws are received for bolting said holder base of the curtain rod tightly against a ceiling or against a wall, that from the holder base, a ledge-shaped neck extends which supports said sliding rod wherein there is an obtuse angle between said holder base and neck, in the formed space between wall/ceiling where the curtain rod is arranged to be fastened to a said ceiling or to a said wall, and that the holders at the top have flanges at least one flange of which is shape-adapted to the cross-sectional shape of the sliding rod and possible to spring apart from the other flange.

Figure 2:
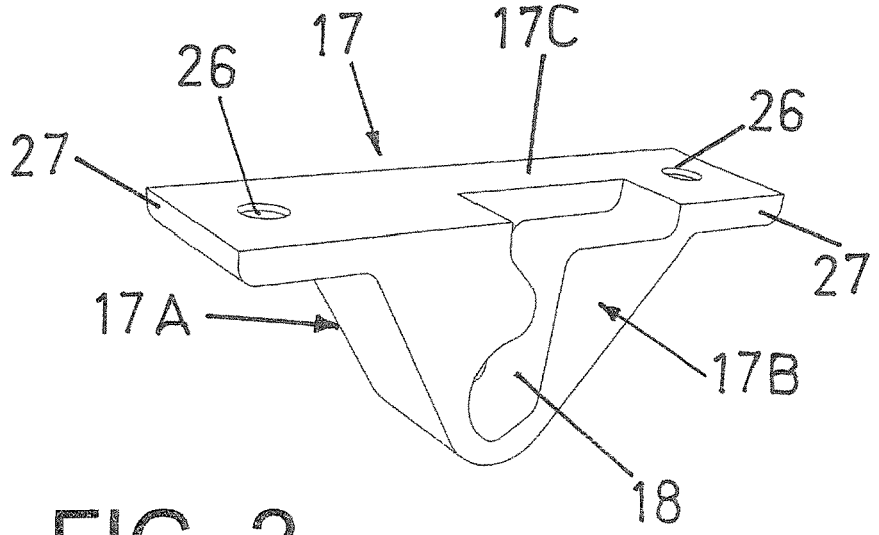
Figure 3:
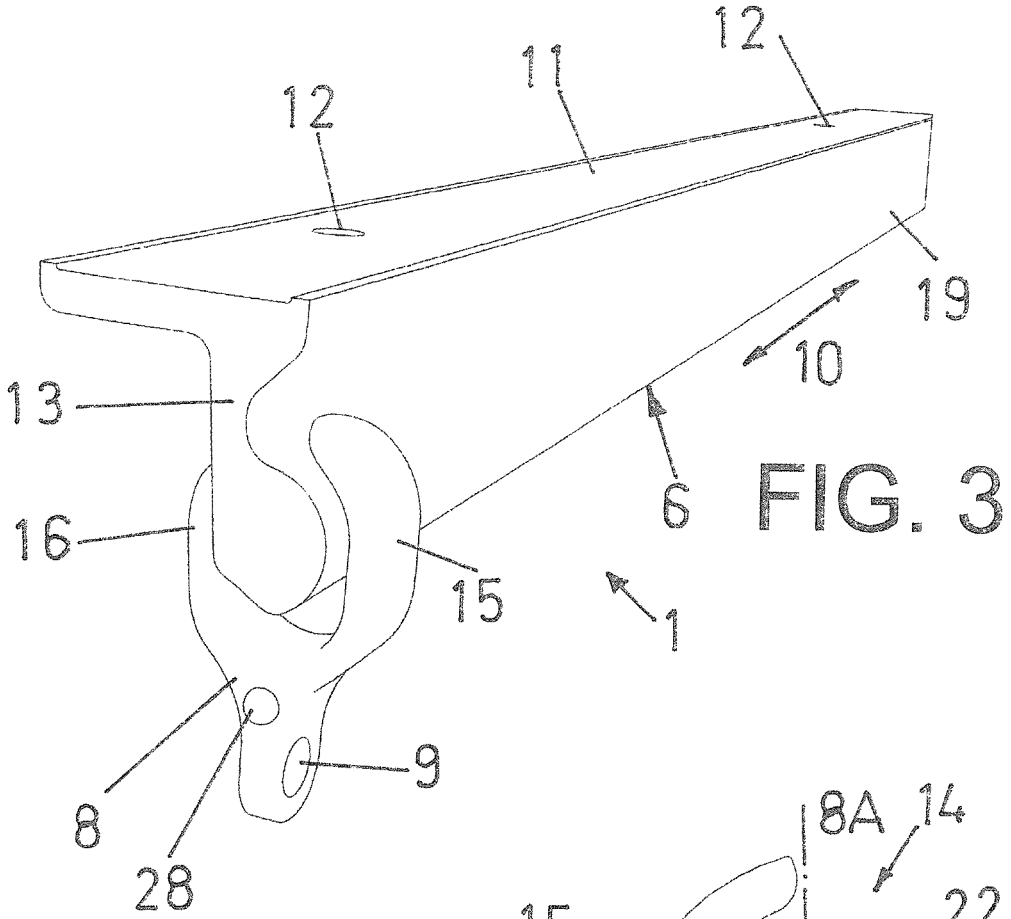
Figure 4:
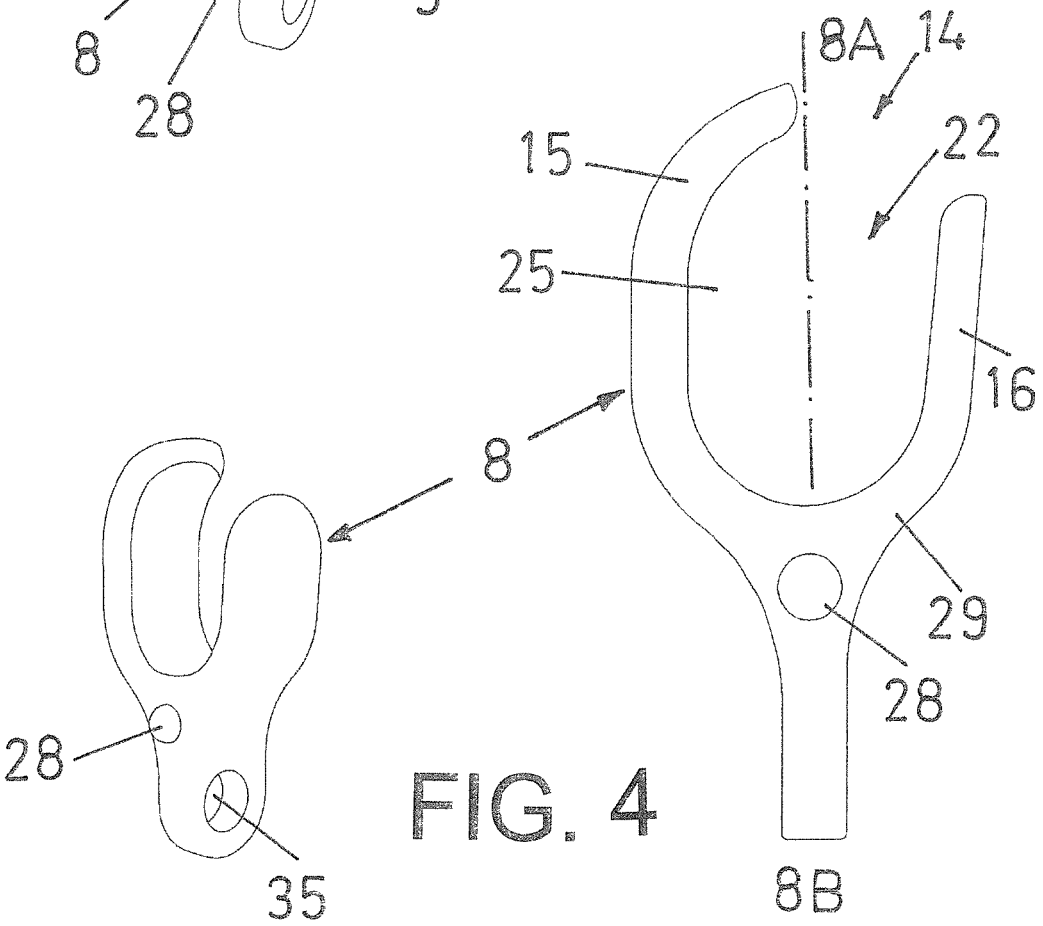
Figure 8:
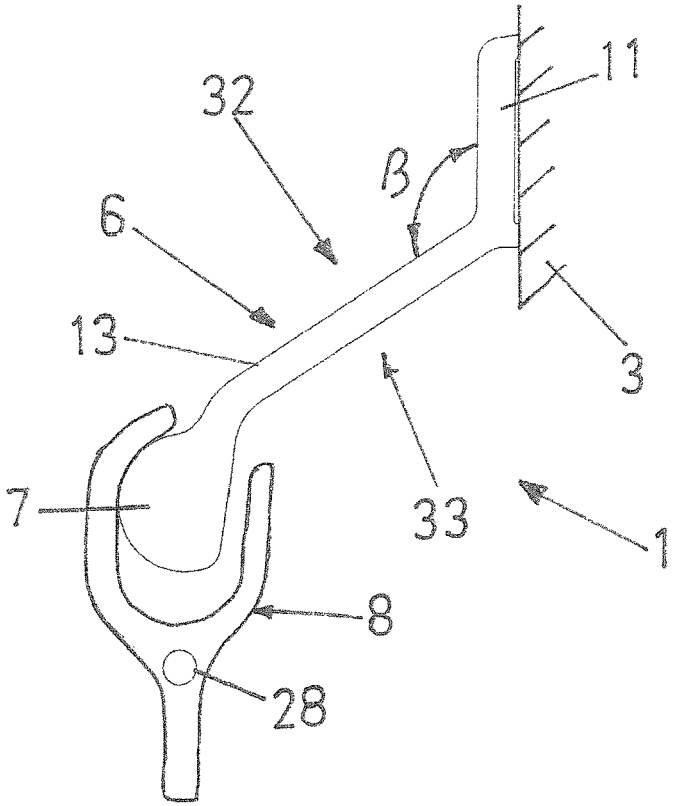
Figure 9:
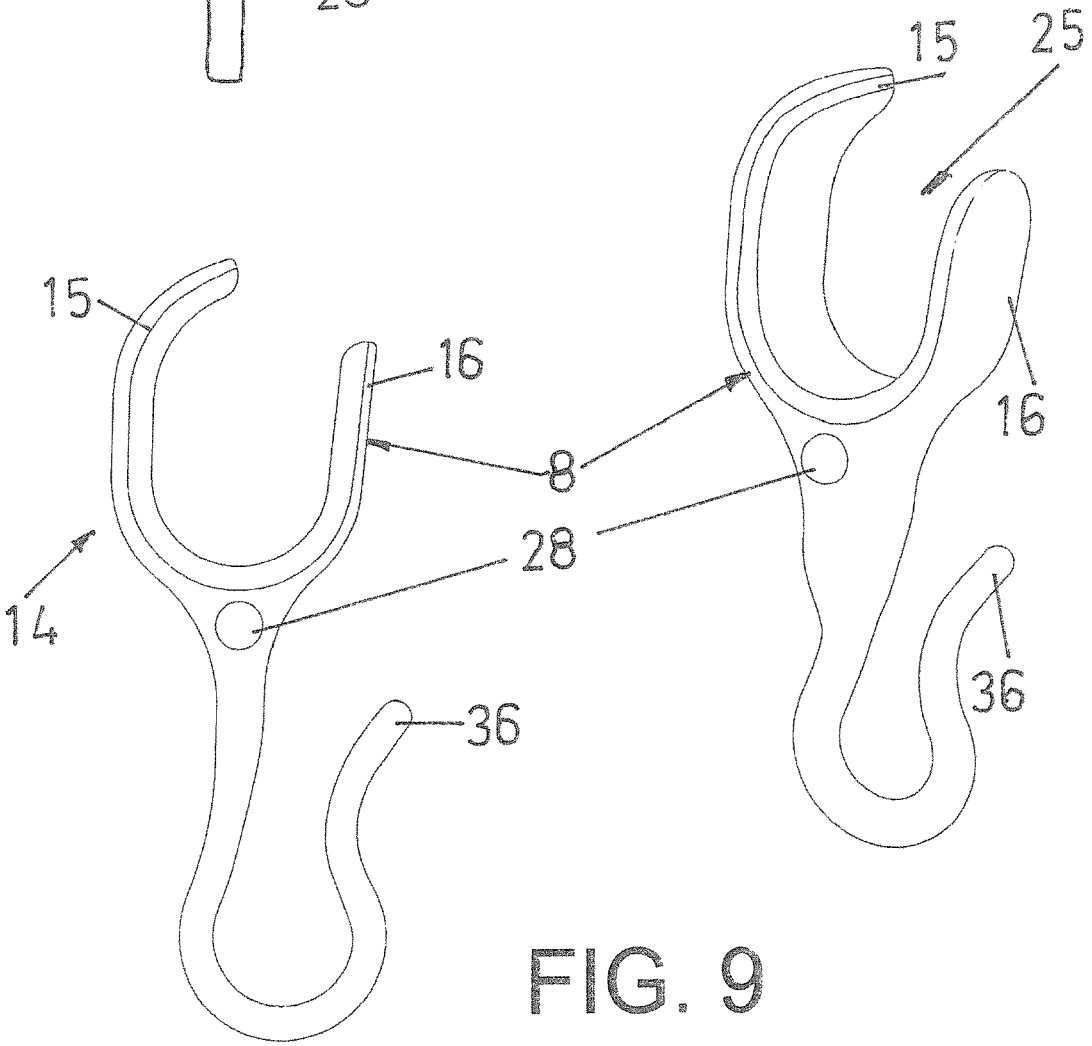
Figure 10:
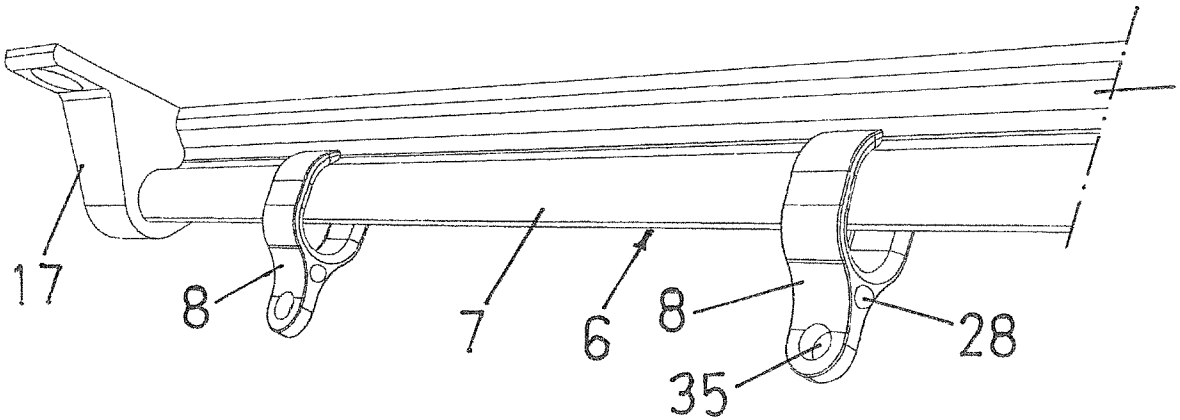
Figure 11:
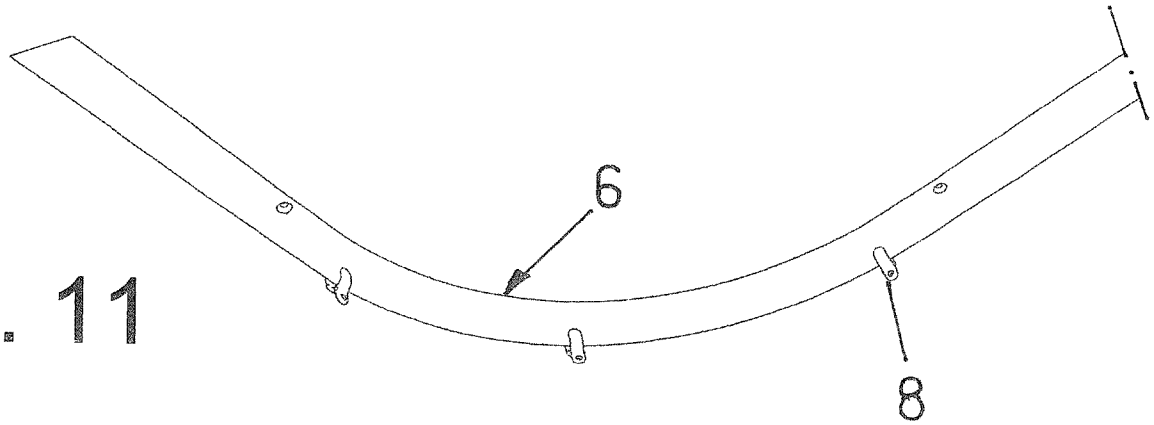
Figure 11:
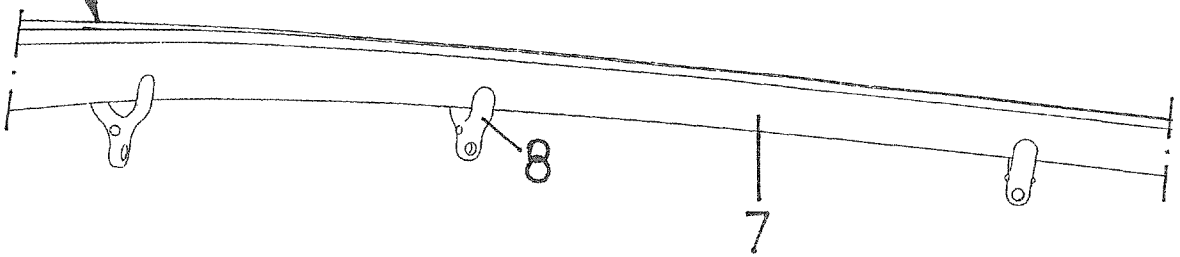

The invention is described in the following in the form of a couple of preferred embodiment examples, reference being made to the accompanying drawings, in which FIGS. 1-4 schematically show a first embodiment example of an arrangement in connection with a curtain rod having end fastening part and holders, wherein, FIG. 1 shows a section view of a curtain rod, which is attached to the ceiling, FIG. 2 shows a suitable end fastening part for a said curtain rod as seen in perspective, FIG. 3 shows a perspective view of the curtain rod having a holder carried thereby, FIG. 4 shows an edge view of a holder, and FIGS. 5-8 show a second embodiment example of an arrangement in connection with a curtain rod having end fastening part and holders, wherein FIG. 5 shows a perspective view of a curtain rod, which is attached to a wall, FIG. 6 shows a suitable end fastening part for a said curtain rod and as seen in perspective, FIG. 7 shows a side view of a curtain rod, end fastening part, and a holder, FIG. 8 shows a section view of the curtain rod and the holder, FIG. 9 shows pictures of a variant of a holder having a fastening hook, FIG. 10 shows a perspective view obliquely from below of a said curtain rod, which is attached to the ceiling having a holder thereon, FIG. 11 shows an example of curved curtain rods having much curvature and little curvature, respectively, FIG. 12 shows a front view of a complete curtain suspension, and FIG. 13 shows an end part of a curtain rod having a holder and an end fastening part.

An arrangement 1 according to the present invention which is suitable to be fastened to a ceiling 2 or to a wall 3 in the room 4 in which it is desired to hang the curtain 5 by means of an attachable curtain rod 6, which in turn has holders 8 slidable along the sliding rod 7 of a curtain rod and supportable by the same, which holders have means 9 for curtain fastening, is arranged to function reliably without risk of persons hurting themselves. More precisely, the curtain rod 6 has a ledge-shaped holder base 11 extending along the length extension 10 of the curtain rod. By preformed holes 12 therein, fixing screws, not shown, are received to allow bolting said holder base 11 of the curtain rod tightly against a ceiling 2 or against a wall 3 in the room 4, etc., in which it is desired to hang the curtain 5.

From said holder base 11, a ledge-shaped neck 13 extends, which is arranged to support said sliding rod 7. In that connection, there is an obtuse angle $\alpha$, $\beta$ between said holder base 11 and the neck 13. The main reason for arranging the angle $\alpha$, $\beta$ to be obtuse is to prevent or at least make it more difficult for persons to be able to attach, e.g., a snare between wall/ceiling 3, 2 and a said neck 13 of the curtain rod 6, where the curtain rod 6 is arranged to be fastened to a said ceiling 2 or to a said wall 3, e.g., by inserting a pen or another solid item in the space 31, 32 therein or in the space 33 that is formed between a wall 3 and said neck 13 of the curtain rod 6, and attach the end of the snare around the pen.

Said holders 8 have at the top 14 at least two flanges 15, 16 at least one flange 15 of which is shape-adapted to the cross-sectional shape of the sliding rod and possible to spring apart from the other, opposite flange 16.

The holder base 11 and neck 13 of a curtain rod are formed of a common, elongate profile ledge of appropriate plastic or metal material, suitably aluminium. Said profile ledges may be cuttable into desired length before mounting of the same and they may be straight, curved, as is shown in FIG. 11, or they are easily bent using a little direct action.

In order to conceal the ends of the curtain rod 6, if it has not been tailor-made exactly to the distance between wall to wall, said profile ledge may be receivable with the respective ends in a respective end fastening part 17, which in turn is arranged tightly attachable against a ceiling or a wall. In that connection, said end fastening parts 17 are closed in one end 17A but have a congruent recess 18 which is arranged in the opposite end 17B and mates with said profile ledge and which is matched before hanging a said curtain rod 6 and the end fastening parts 17 on a ceiling or on a wall. The end fastening parts 17 are there to prevent a snare from being attached in the space between rod end and ceiling/wall or between the rod ends.

With the purpose of preventing insertion and attachment of, e.g., one end of a snare between the wall 3 and the end fastening part 17, said one end 17A of the end fastening part 17 is arranged sloping 30 or curved in the direction from the connection portion 17C thereof to a ceiling 2 or a wall 3. It is also important there that no space is obtained that allows attachment a rope, etc., so that persons are prevented from getting hurt.

Suitably, said sliding rod 7 has a curved side 19 along the end 7A thereof turned in the direction from the holder base 11 and a straight side 20 on the opposite side. Between each a side A, B of a said curved side 19 and a straight side 20, a straight surface 21 or a curved surface extends, which links together the two sides 19, 20 with each other.

Said holders 8 are preferably formed of y-shaped clips having an opening 22 and means, e.g., Velcro© fastening means 9 or another suitable fastening means for securing a curtain by appropriate means, e.g., Velcro© fastening means, in a respective diametrically opposite end 8A, 8B. The material of the holders 8 is preferably acetal plastic (POM), polyamide (PA), etc., or resilient metal.

In case of a sliding rod 7 having a curved at least one side 19, a fitting holder 8 has at least one curved one flange 15. Simultaneously, the holders 8 have a counter-positioned straight flange 16. Said curved and straight, respectively, flanges 15, 16 abut along and co-operate with, respectively, the curved and straight, respectively, sides 19, 20 of the sliding rod 7. As is shown in the drawings, a superpositioned opening 22 reaching into the internal space 25 of the holders is laterally displaced as seen to the opposite end 8B of the holders 8.

For a reliable fastening of the curtain rod 6, without possibility of loosening the same without special tools, through fastening holes 12, 26 are arranged for screws, e.g., one-way screws, to extend through holder base 11 and mounting flanges 27 of end fastening parts.

In order to prevent a plurality of holders 8 from being interengaged close to each other with the sides of the holders 8 abutting tightly together, so that it would be possible to increase the bearing capacity should someone try to arrange some kind of snare or another hang means in a plurality of holders 8, the holders 8 have a thickening 28, for instance in the form of a boss-like projecting bulge, stud, etc., on one or both opposed sides 29 of the holder.

Furthermore, at least one flange 15, the curved one, of the holders is arranged to spring apart from the counter-positioned paired flange 16, the straight one, upon load by a certain predetermined force acting on the respective holder and/or groups of holders in brought-together positions, so that they spring apart and open and come loose from the sliding rod 7 in question long before a person's weight is reached, e.g. at 15 kg or less.

As curtain holding means, in addition to the above-mentioned Velcro© fastening elements, these may be holes 35 for supporting fork curtain holders or sewing thread or other fastening means present therein or receivable on the holders 8.

It is also possible, as is shown in the drawings in FIG. 9, to arrange the holders 8 with hooks 36 in the lower ends thereof for supporting the curtain 5 by inserting the hooks 36 into, e.g., holes 37 along the upper edge side of the curtain or by utilizing folding strips, etc.

The function and nature of the invention should have been clearly understood from the above-mentioned and also with knowledge of what is shown in the drawings but the invention is naturally not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. An anti-ligature curtain rod assembly, comprising:

a curtain rod configured to attach to one of a ceiling and a wall, the curtain rod comprising:

a sliding rod;

a ledge-shaped holder base that extends along a length of the curtain rod, the holder base configured to receive fixing screws for fastening the holder base tight against the one of the ceiling and the wall; and a ledge-shaped neck extending from the holder base to the sliding rod, the neck supporting the sliding rod;

wherein the neck extends at an obtuse angle from the holder base in a direction away from the other one of the ceiling and the wall; and a plurality of graspable holders configured to slide along and be supported by the sliding rod, the plurality of graspable holders each comprising:

a means for holding a curtain;

a first flange; and a second flange;

wherein at least one of the first flange and the second flange has a shape corresponding to a cross-sectional shape of the sliding rod.

2. The anti-ligature curtain rod assembly of claim 1, wherein the holder base and the neck have a common, elongate ledge profile and are made of plastic or metal.

3. The anti-ligature curtain rod assembly of claim 2, further comprising:

a first end fastening part and a second end fastening part;

wherein a first end of the ledge profile is received in the first end fastening part and a second end of the ledge profile is received in the second end fastening part; and wherein the first and second end fastening parts are configured to be tightly attachable against the one of the ceiling or the wall.

4. The anti-ligature curtain rod assembly of claim 3, wherein the each of the first and second end fastening parts are closed at one end with a sloping or curved side surface and at their opposite ends have recesses that mate with the ledge profile.

5. The anti-ligature curtain rod assembly of claim 1, wherein the sliding rod further comprises a curved surface along a side facing away from the holder base.

6. The anti-ligature curtain rod assembly of claim 5, wherein the sliding rod further comprises a straight surface along a side facing toward the holder base.

7. The anti-ligature curtain rod assembly of claim 6, wherein the sliding rod further comprises a connecting surface extending between the curved surface and the straight surface.

8. The anti-ligature curtain rod assembly of claim 1, wherein the plurality of graspable holders are y-shaped, and the means for holding the curtain are located on a third flange extending downward from said first and second flanges.

9. The anti-ligature curtain rod assembly of claim 8, wherein at least one of the first and second flanges of the graspable holders is curved.

10. The anti-ligature curtain rod assembly of claim 9, wherein a gap between the first flange and the second flange is offset with respect to the third flange.

11. The anti-ligature curtain rod assembly of claim 9, wherein at least one of the first and second flanges of the graspable holders is straight.

12. The anti-ligature curtain rod assembly of claim 11, wherein a gap between the first flange and the second flange is offset with respect to the third flange.

13. The anti-ligature curtain rod assembly of claim 1, wherein the holder base further comprises holes configured to receive the fixing screws.

14. The anti-ligature curtain rod assembly of claim 1, wherein the plurality graspable holders each have at least one thickening protrusion that prevents close abutment of the graspable holders against each other in a row.

15. The anti-ligature curtain rod assembly of claim 1, wherein at least one of the first and second flange is configured to spring apart from at least one other of the first and second flange.

16. The anti-ligature curtain rod assembly of claim 15, wherein the at least one of the first and second flange is arranged to spring apart in response to a predetermined force acting on the respective graspable holder.

17. The anti-ligature curtain rod assembly of claim 1, wherein the means for holding the curtain are hook-and-loop fasteners, holes, or hooks for supporting fork curtain holders, folding strips, or sewing threads, receivable therein or in mating openings in the curtain.

* * * * *